US011646503B2

(12) United States Patent
Lim et al.

(10) Patent No.: US 11,646,503 B2
(45) Date of Patent: May 9, 2023

(54) ANTENNA APPARATUS

(71) Applicant: Samsung Electro-Mechanics Co., Ltd., Suwon-si (KR)

(72) Inventors: Dae Ki Lim, Suwon-si (KR); Nam Ki Kim, Suwon-si (KR); Myeong Woo Han, Suwon-si (KR); Jeong Ki Ryoo, Suwon-si (KR); Ju Hyoung Park, Suwon-si (KR); Won Cheol Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 191 days.

(21) Appl. No.: 16/661,084

(22) Filed: Oct. 23, 2019

(65) Prior Publication Data

US 2020/0395679 A1 Dec. 17, 2020

(30) Foreign Application Priority Data

Jun. 12, 2019 (KR) ..... 10-2019-0069536

(51) Int. Cl.
*H01Q 1/24* (2006.01)
*H01Q 21/06* (2006.01)
*H01Q 21/00* (2006.01)

(52) U.S. Cl.
CPC ..... *H01Q 21/065* (2013.01); *H01Q 1/243* (2013.01); *H01Q 21/0025* (2013.01)

(58) Field of Classification Search
CPC ..... H01Q 1/243; H01Q 1/2283; H01Q 1/523; H01Q 1/38; H01Q 1/48; H01Q 1/50; H01Q 21/0025; H01Q 21/065; H01Q 21/08; H01Q 21/28; H01Q 21/0006; H01Q 9/0435; H01Q 9/045; H01Q 9/0414; H01Q 9/0407
See application file for complete search history.

(56) References Cited

U.S. PATENT DOCUMENTS 6,008,763 A * 12/1999 Nystrom ..... H01Q 21/08 343/700 MS
7,518,513 B2 4/2009 Liu
8,803,757 B2 8/2014 Shen et al.
10,193,231 B2 1/2019 Wallace et al.
2001/0020920 A1 9/2001 Shigihara
(Continued)

FOREIGN PATENT DOCUMENTS

JP 2000-510305 A 8/2000
JP 2010-503357 A 1/2010
(Continued)

OTHER PUBLICATIONS

The American Radio Relay League, Gerald Hall (Year: 1988).*
(Continued)

*Primary Examiner* — Awat M Salih
(74) *Attorney, Agent, or Firm* — NSIP Law

(57) ABSTRACT

An antenna apparatus may include: first patch antenna patterns arrayed in an N×1 structure, the first patch antenna patterns each having a polygonal shape having an oblique side with respect to an array direction of the N×1 structure; feed vias electrically connected to the first patch antenna patterns; and guide vias arrayed along the oblique side, wherein N is a natural number greater than or equal to 2.

16 Claims, 11 Drawing Sheets

(56) References Cited

U.S. PATENT DOCUMENTS

| | | | | |
|---|---|---|---|---|
| 2005/0206568 | A1* | 9/2005 | Phillips | H01Q 5/40 343/700 MS |
| 2010/0039345 | A1 | 2/2010 | Kim et al. | |
| 2012/0038529 | A1 | 2/2012 | Yoo et al. | |
| 2012/0154237 | A1* | 6/2012 | Ying | H01Q 5/378 343/833 |
| 2015/0042513 | A1* | 2/2015 | Foo | H01Q 9/0457 343/834 |
| 2015/0138035 | A1* | 5/2015 | Lee | H01Q 9/045 343/843 |
| 2015/0207235 | A1* | 7/2015 | Lee | H01Q 21/24 343/767 |
| 2016/0013558 | A1* | 1/2016 | Hwang | H01Q 9/0457 343/906 |
| 2017/0271781 | A1 | 9/2017 | Gururaja Rao et al. | |
| 2019/0115664 | A1* | 4/2019 | Veihl | H01Q 9/0414 |
| 2020/0287298 | A1* | 9/2020 | Ueda | H01Q 9/0407 |
| 2020/0303821 | A1* | 9/2020 | Lee | H01Q 5/335 |
| 2021/0143535 | A1 | 5/2021 | Watanabe et al. | |

FOREIGN PATENT DOCUMENTS

| | | | |
|---|---|---|---|
| JP | 2013-150112 | A | 8/2013 |
| JP | 6490319 | B1 | 3/2019 |
| KR | 10-2001-0082693 | A | 8/2001 |
| KR | 10-0805028 | B1 | 2/2008 |
| KR | 10-0951197 | B1 | 4/2010 |
| KR | 10-1124131 | B1 | 3/2012 |
| KR | 10-1436007 | B1 | 9/2014 |
| WO | WO 97/43799 | A1 | 11/1997 |

OTHER PUBLICATIONS

Korean Office Action dated Jan. 9, 2020 in the corresponding Korean Patent Application No. 10-2019-0069536 (5 pages in English, 4 pages in Korean).

Korean Office Action dated Sep. 20, 2022, in counterpart of Korean Patent Application No. 10-2020-0121963 (5 Pages in Korean, 3 Pages in English).

* cited by examiner

ANTENNA APPARATUS

CROSS-REFERENCE TO RELATED APPLICATIONS

This application claims the benefit under 35 USC § 119(a) of Korean Patent Application No. 10-2019-0069536 filed on Jun. 12, 2019 in the Korean Intellectual Property Office, the entire disclosure of which is incorporated herein by reference for all purposes.

BACKGROUND

1. Field

The following description relates to an antenna apparatus.

2. Description of Related Art

Mobile communications data traffic is increasing rapidly on a yearly basis.

Technological development to support such a leap in real time data traffic in wireless network is underway. For example, applications of the contents of Internet of Things (IoT) based data, live VR/AR in combination with augmented reality (AR), virtual reality (VR), and social networking services (SNS), autonomous navigation, a synch view for real-time image transmission from a user's view point using a subminiature camera, and the like, require communications for supporting the exchange of large amounts of data, for example, 5th generation (5G) communications, millimeter wave (mmWave) communications, or the like.

Thus, millimeter wave (mmWave) communications including 5G (5G) communications have been researched, and research into the commercialization/standardization of antenna apparatuses to smoothly implement such millimeter wave (mmWave) communications have been undertaken.

RF signals in high frequency bands of, for example, 24 GHz, 28 GHz, 36 GHz, 39 GHz, 60 GHz and the like, are easily absorbed in the course of transmission and lead to signal loss. Thus, the quality of communications may deteriorate sharply. Therefore, antennas for communications in high frequency bands require a different technical approach from that of related art antenna technology, and may require special technological development, such as for separate power amplifiers or the like, to secure antenna gain, integrate an antenna and an RFIC, and secure Effective Isotropic Radiated Power (EIRP) and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: first patch antenna patterns arrayed in an N×1 structure, the first patch antenna patterns each having a polygonal shape having an oblique side with respect to an array direction of the N×1 structure; feed vias electrically connected to the first patch antenna patterns; and guide vias arrayed along the oblique side, wherein N is a natural number greater than or equal to 2.

Each of the first patch antenna patterns may include first slits located in the oblique side.

Portions protruding from the first patch antenna patterns by the first slits may protrude toward one of the guide vias.

The antenna apparatus may further include second patch antenna patterns spaced apart from each other and disposed above the first patch antenna patterns, the second patch antenna patterns each having an area less than an area of a corresponding first patch antenna pattern among the first patch antenna patterns, and each having a second polygonal shape having a second oblique side with respect to the array direction. Each of the second patch antenna patterns may include second slits located in the second oblique side.

A length of each of the second slits may be greater than a length of each of the first slits.

A width of each of the second slits may be less than a width of each of the first slits.

The antenna apparatus may further include guide patterns each electrically connected to a corresponding guide via among the guide vias, and each having a width greater than a width of the corresponding guide via.

The antenna apparatus may further include second patch antenna patterns spaced apart from each other and disposed above the first patch antenna patterns, the second patch antenna patterns each having an area less than an area of a corresponding first patch antenna pattern among the first patch antenna patterns, and each having a second polygonal shape having a second oblique side with respect to the array direction. The guide patterns may be disposed at a same height as a height of the first patch antenna patterns.

The antenna apparatus may further include second patch antenna patterns spaced apart from each other and disposed above the first patch antenna patterns, the second patch antenna patterns each having an area less than an area of a corresponding first patch antenna pattern among the first patch antenna patterns. The feed vias may be configured to feed power directly to the second patch antenna patterns, and to feed power indirectly to the first patch antenna patterns.

The antenna apparatus may further include feed patterns each electrically connected to a corresponding feed via among the feed vias, and each having a width greater than a width of the corresponding feed via. The first patch antenna patterns may each have a through-hole in which a corresponding feed pattern among the feed patterns is disposed.

The antenna apparatus may further include coupling patch patterns spaced apart from each other above the second patch antenna patterns.

Each of the feed vias may be electrically connected to a corresponding first patch antenna pattern among the first patch antenna patterns. The feed vias may be disposed to be biased toward the oblique side from a center of the corresponding first patch antenna pattern.

The antenna apparatus may further include second feed vias respectively electrically connected to the corresponding first patch antenna pattern among the first patch antenna patterns. The second feed vias may be disposed to be biased from the center of the corresponding first patch antenna pattern in a direction different from the direction in which the feed vias are biased from the center of the corresponding first patch antenna pattern.

The antenna apparatus may further include a ground plane having through-holes through which the feed vias penetrate. The guide vias may be electrically connected to the ground plane.

The antenna apparatus may further include a dielectric body in which the first patch antenna patterns, the feed vias and the guide vias are disposed, the dielectric body having a polyhedral shape and having sides oblique with respect to the oblique side.

The antenna apparatus may further include: first electrical connection structures each electrically connected to a corresponding feed via among the feed vias, and each having a melting point lower than a melting point of the corresponding feed via; and second electrical connection structures each electrically connected to a corresponding guide via among the guide vias, and each having a melting point lower than a melting point of the corresponding guide via.

In another general aspect, an antenna apparatus includes: first patch antenna patterns arranged in an row and each having a polygonal shape, wherein the first patch antenna patterns include one first patch antenna pattern and another first patch antenna pattern disposed adjacent to each other, and wherein a side of the one first patch antenna pattern and a side of the other first patch antenna pattern opposite the side of the one first patch antenna pattern are nonparallel to each other; feed vias respectively electrically connected to the first patch antenna patterns; and guide vias arrayed along the side of the one first patch antenna pattern and along the side of the other first patch antenna pattern.

The antenna apparatus may further include slits disposed in the side of the one first patch antenna pattern and the side of the other first patch antenna pattern.

The antenna apparatus may further include second patch antenna patterns spaced apart from each other and disposed above the first patch antenna patterns. The second patch antenna patterns may each have a polygonal shape and an area less than an area of a corresponding first patch antenna pattern among the first patch antenna patterns.

The second patch antenna patterns may include one second patch antenna pattern and another second patch antenna pattern disposed adjacent to each other. A side of the one second patch antenna pattern and a side of the other second patch antenna pattern opposite the side of the one second patch antenna pattern may be nonparallel to each other.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
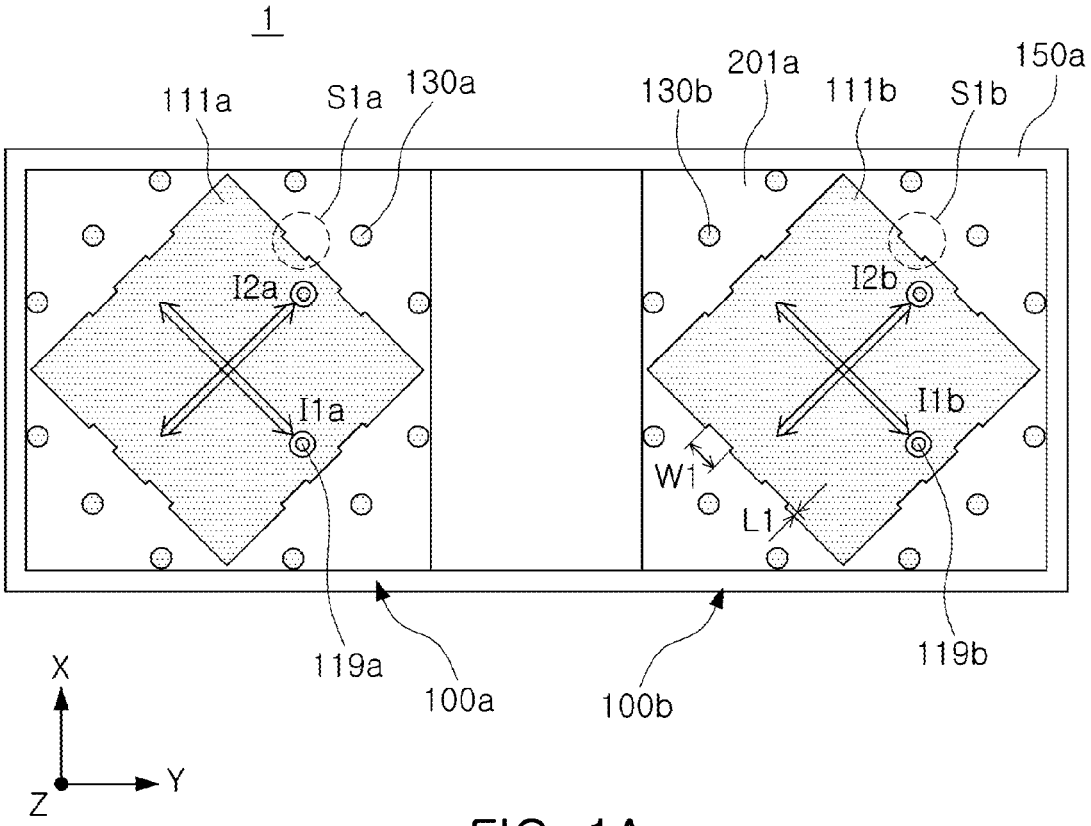
FIG. 1A is a plan view of an antenna apparatus, according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The examples discussed in the following description provide an antenna apparatus capable of improving antenna performance, for example, gain, a bandwidth, directivity or the like, and/or having a structure favorable for miniaturization.

Figure 2A:
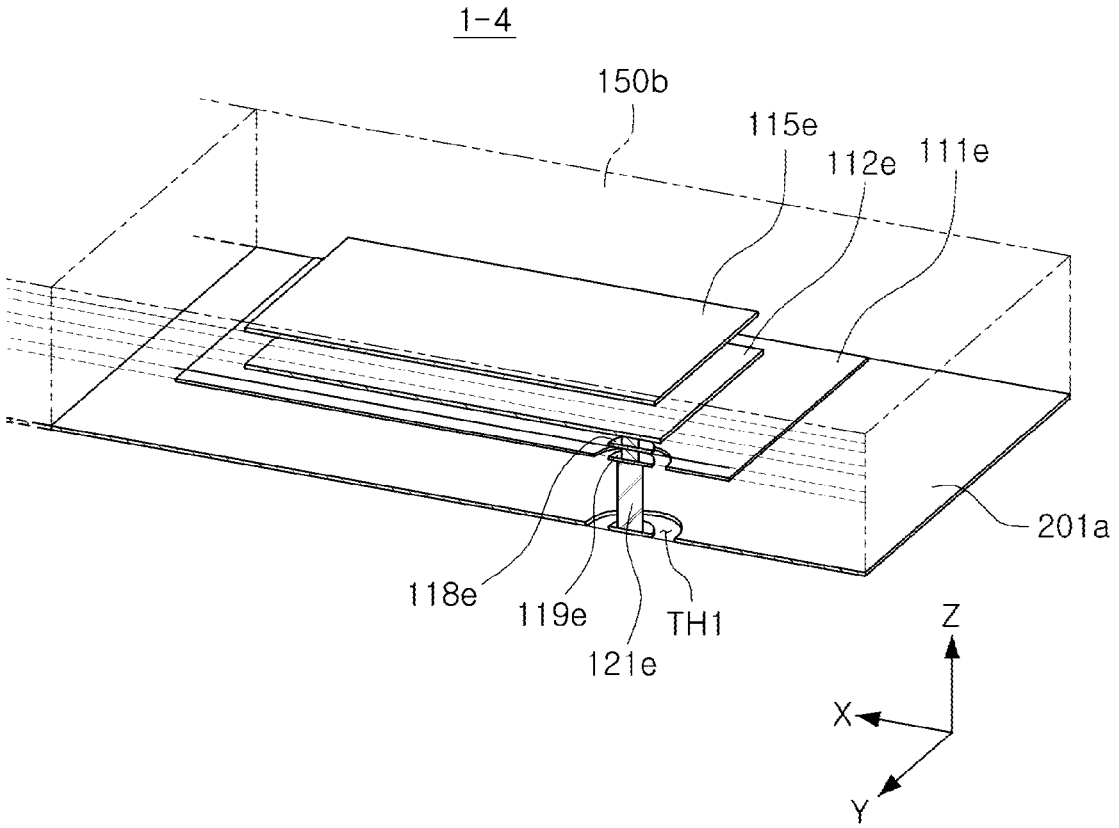
FIGS. 2A and 2B are perspective views illustrating an antenna apparatus, according to an example.
Figure 2B:
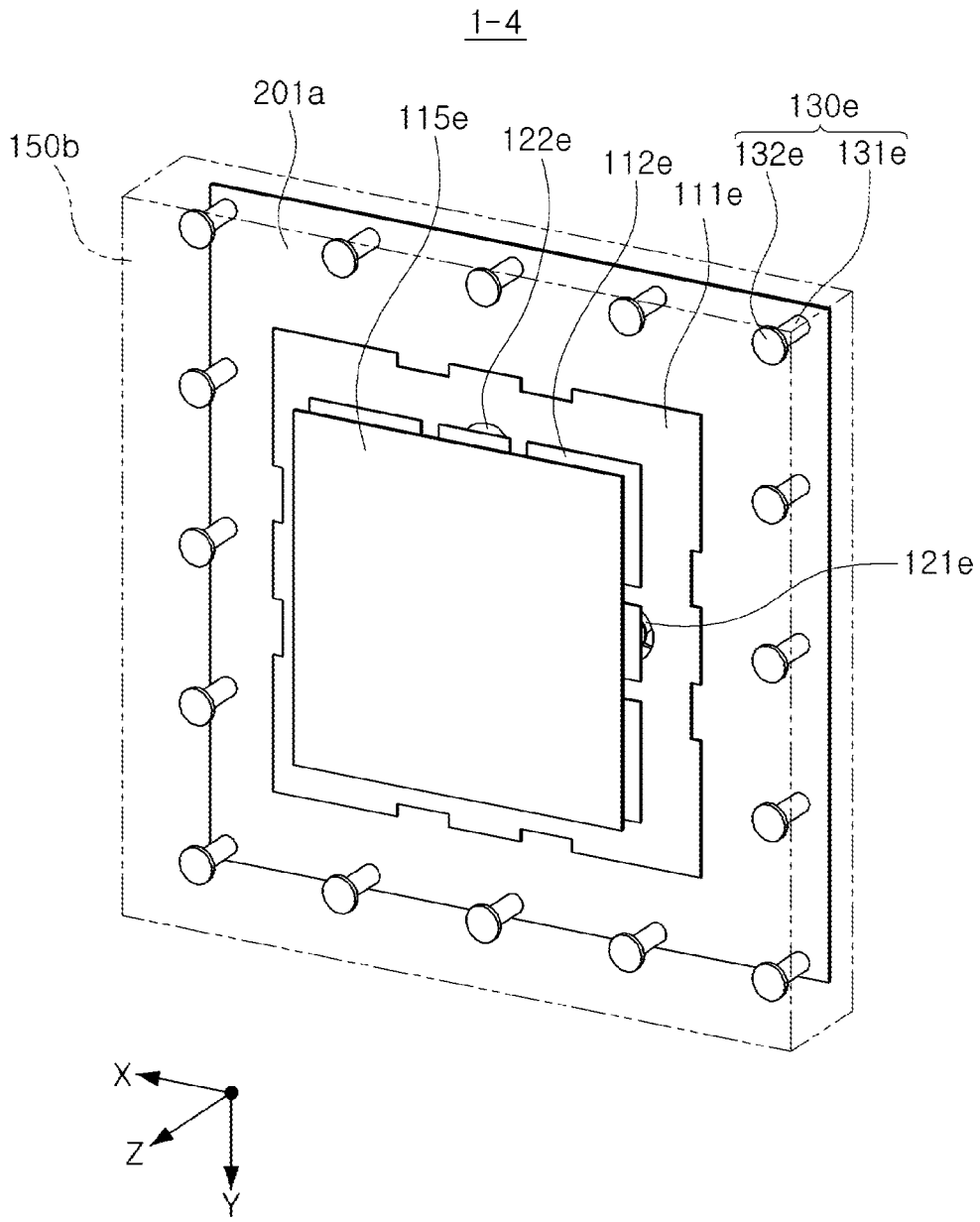

FIG. 1A is a plan view of an antenna apparatus 1, according to an example. FIGS. 2A and 2B are perspective views illustrating an antenna unit 100*e* of the antenna apparatus, according to an example.

Referring to FIG. 1A, the antenna apparatus 1 may include first and second antenna units 100*a* and 100*b*. For example, the antenna apparatus 1 may have a structure in which the antenna units illustrated in FIGS. 2A and 2B are arrayed in an N×1 structure. In this case, N is a natural number greater than or equal to 2.

Referring to FIGS. 1A, 2A and 2B, the antenna apparatus 1 includes first patch antenna patterns 111*a*, 111*b*, and 111*e*, feed vias 121*e* and 122*e*, and a plurality of guide vias 130*a*, 130*b*, and 130*e*, and may further include a ground plane 201*a* and a dielectric body 150*a*, 150*b*.

The feed vias 121*e* are electrically connected to corresponding first patch antenna patterns 111*a*, 111*b*, and 111*e* among the first patch antenna patterns 111*a*, 111*b*, and 111*e*, respectively, and may serve as electrical paths of a radio frequency (RF) signal.

For example, the feed vias 121*e* may include feed patterns 119*a*, 119*b*, and 119*e*, and may feed power indirectly to the first patch antenna patterns 111*a*, 111*b*, and 111*e*, without contacting the first patch antenna patterns 111*a*, 111*b* and 111*e*, through the feed patterns 119*a*, 119*b*, and 119*e*.

For example, the feed vias 121*e* may be disposed to pass through through-holes TH1 of the ground planes 201*a*.

RF signals transmitted through the feed vias 121*e* may be remotely transmitted and received in a vertical direction, for example, in a Z direction, from the first patch antenna patterns 111*a*, 111*b*, and 111*e*.

The ground planes 201*a* may act as a reflector, electromagnetically, with respect to the first patch antenna patterns 111*a*, 111*b*, and 111*e*. Therefore, the remote transmission/reception direction of RF signals of the plurality of first patch antenna patterns 111*a*, 111*b*, and 111*e* may be further concentrated on the upper side of the first patch antenna patterns 111*a*, 111*b*, and 111*e*.

The RF signal may be transmitted from an Integrated Circuit (IC) to the first patch antenna patterns 111*a*, 111*b*, and 111*e* at the time of transmission, and may be transmitted from the first patch antenna patterns 111*a*, 111*b*, and 111*e* to the IC at the time of reception.

The first patch antenna patterns 111*a*, 111*b* and 111*e* may form a radiation pattern in the vertical direction, for example, in the z direction, as a surface current flows to the upper surface of the first patch antenna patterns 111*a*, 111*b* and 111*e*.

The direction and/or a magnitude of the surface current flowing through the first patch antenna patterns 111*a*, 111*b*, and 111*e* is determined by impedance, for example, capacitance and/or inductance, of each of the first patch antenna patterns 111*a*, 111*b*, and 111*e*.

In the electromagnetic boundary conditions of sides of polygons of the first patch antenna patterns 111*a*, 111*b*, and 111*e* (e.g., polygonal structures formed by the first patch antenna patterns 111*a*, 111*b*, and 111*e*), surface currents may flow from one sides of the polygons of the first patch antenna patterns 111*a*, 111*b*, and 111*e* to the other sides thereof, depending on electromagnetic boundary conditions at centers of the polygons.

For example, when the remote transmission/reception direction of the RF signal is a vertical direction, for example, a Z direction, electric fields of the first patch antenna patterns 111*a*, 111*b*, and 111*e* are formed in the same direction as a direction of the surface current (for example, in an X or Y direction) while being in a horizontal direction, and magnetic fields of the first patch antenna patterns 111*a*, 111*b*, and 111*e* may be formed in a direction perpendicular to the direction of the surface current, for example, in the Y direction or the X direction while being in a horizontal direction.

The gain of the first patch antenna patterns 111*a*, 111*b*, and 111*e* may be increased as the number of the first patch antenna patterns 111*a*, 111*b*, and 111*e* increases. However, if one side of the polygon of the first patch antenna patterns 111*a*, 111*b*, and 111*e* faces a first patch antenna pattern adjacent thereto, the electric field and the magnetic field of the first patch antenna patterns 111*a*, 111*b*, and 111*e* cause electromagnetic interference with the adjacent first patch antenna pattern. The electromagnetic interference may degrade the gain and/or directivity of the first patch antenna patterns 111*a*, 111*b*, and 111*e*.

Accordingly, the first patch antenna patterns 111*a*, 111*b*, and 111*e* are arrayed in the N×1 structure, and each of the first patch antenna patterns 111*a*, 111*b*, and 111*e* has a polygonal shape having an oblique side that is configured to extend obliquely with respect to the array direction, for example, the Y direction.

Thus, one side of a polygon of each of the first patch antenna patterns 111*a*, 111*b*, and 111*e* may not be directed to a first patch antenna pattern adjacent thereto. For example, one side of the polygon of a first patch antenna pattern 111*a*, 111*b*, or 111*e* and an opposing side of the polygon of the adjacent first patch antenna pattern 111*a*, 111*b*, or 111*e* may not be parallel to each other. Therefore, a phenomenon in which the electric field and the magnetic field of the first patch antenna patterns 111*a*, 111*b*, and 111*e* cause electromagnetic interference with an adjacent first patch antenna pattern may be reduced, and the gain and/or directivity of the first patch antenna patterns 111*a*, 111*b*, and 111*e* may be improved.

The guide vias 130*a*, 130*b*, and 130*e* are arrayed along oblique sides of the plurality of first patch antenna patterns 111*a*, 111*b*, and 111*e*.

Accordingly, the guide vias 130*a*, 130*b* and 130*e* may be electromagnetically coupled to the oblique sides of the first patch antenna patterns 111*a*, 111*b*, and 111*e*, and may widen bandwidths of the first patch antenna patterns 111*a*, 111*b*, and 111*e*.

The direction and/or magnitude of surface currents flowing through the first patch antenna patterns 111*a*, 111*b*, and 111*e* may be affected by impedance formed depending on the electromagnetic coupling of the guide vias 130*a*, 130*b*, and 130*e* as well as by impedance, for example, capacitance and/or inductance, of each of the first patch antenna patterns 111*a*, 111*b*, and 111*e*.

Therefore, the electromagnetic coupling of the guide vias 130*a*, 130*b*, and 130*e* may guide the surface currents of the first patch antenna patterns 111*a*, 111*b*, and 111*e* to flow more intensively toward the oblique sides.

Accordingly, a ratio of energy flowing toward the adjacent first patch antenna pattern among the surface currents of first patch antenna patterns 111*a*, 111*b* and 111*e* may be further reduced. Therefore, a phenomenon in which the electric fields and the magnetic fields of the first patch antenna patterns 111*a*, 111*b*, and 111*e* cause electromagnetic interference with the adjacent first patch antenna pattern may be more efficiently reduced. In addition, the gain and/or directivity of the first patch antenna patterns 111*a*, 111*b*, and 111*e* may be further improved.

The first patch antenna patterns 111*a*, 111*b*, and 111*e* may have first slits S1*a* and S1*b* located in oblique sides thereof. First slits S1*a* and S1*b* may affect the electromagnetic boundary conditions and the impedance of oblique sides of the polygon of each of the first patch antenna patterns 111*a*, 111*b*, and 111*e*, and may thus guide the surface currents of the first patch antenna patterns 111*a*, 111*b*, and 111*e* to flow more intensively toward the oblique sides.

A portion protruding adjacent to the first slits S1*a* and S1*b* in the first patch antenna patterns 111*a*, 111*b* and 111*e* may protrude toward one of the guide vias 130*a*, 130*b* and 130*e*. The protruding portion may serve as a relay point for the electromagnetic coupling of the guide vias 130*a*, 130*b* and 130*e*. Thus, the surface currents of the first patch antenna patterns 111*a*, 111*b* and 111*e* may flow more intensively toward the oblique sides.

The first slits S1*a* and S1*b* may each have a first length L1 and a first width W1.

Figure 1B:
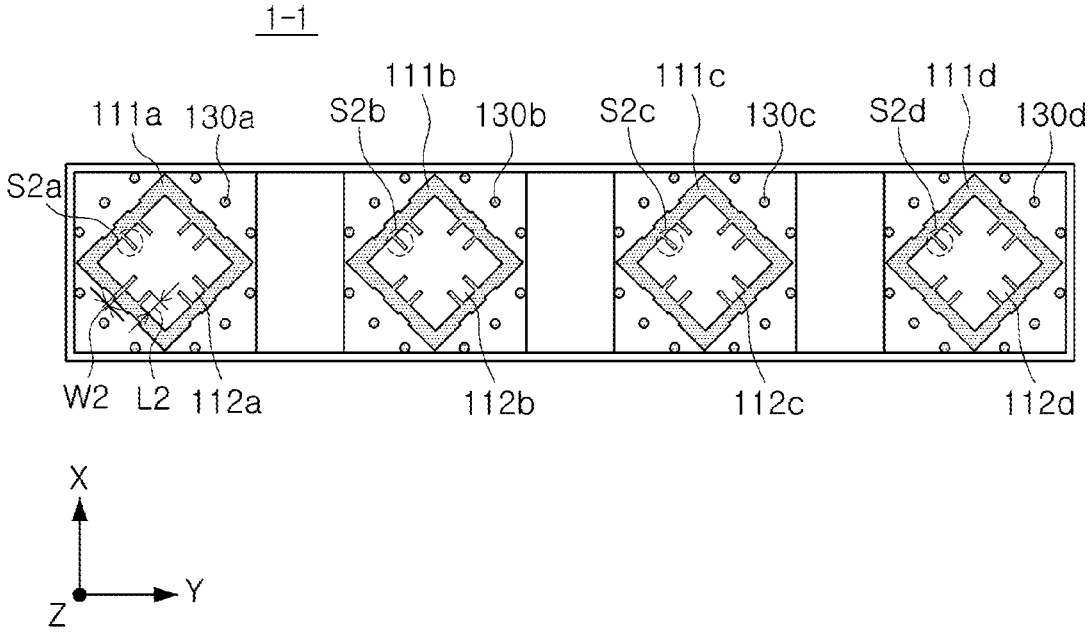
FIG. 1B is a plan view illustrating an antenna apparatus including a second patch antenna pattern, according to an example.

FIG. 1B is a plan view of an antenna apparatus 1-1 including a second patch antenna pattern, according to an example.

Referring to FIGS. 1B, 2A and 2B, the antenna apparatus 1-1 includes first patch antenna patterns 111*a*, 111*b*, 111*c*, 111*d*, and 111*e*, and may further include second patch antenna patterns 112*a*, 112*b*, 112*c*, 112*d*, and 112*e* disposed above the first patch antenna patterns 111*a*, 111*b*, 111*c*, 111*d*, and 111*e* spaced apart from each other.

The second patch antenna patterns 112*a*, 112*b*, 112*c*, 112*d*, and 112*e* may each have an area less than an area of a corresponding one of the first patch antenna patterns 111*a*, 111*b*, 111*c*, 111*d*, and 111*e*, and thus, may each have a resonance frequency higher than a resonance frequency of the corresponding one of the first patch antenna patterns 111*a*, 111*b*, 111*c*, 111*d*, and 111*e*.

For example, the antenna apparatus 1-1 may remotely transmit and receive a first RF signal of a relatively low frequency (for example, 28 GHz) through the first patch antenna patterns 111*a*, 111*b*, 111*c*, 111*d*, and 111*e* by remote, and may remotely transmit and receive a second RF signal of a relatively high frequency (for example, 39 GHz) through the second patch antenna patterns 112*a*, 112*b*, 112*c*, 112*d*, and 112*e*.

The plurality of second patch antenna patterns 112*a*, 112*b*, 112*c*, 112*d*, and 112*e* may be arrayed in an Nx1 structure, and may each have an oblique side with respect to an array direction, for example, the Y direction. For example, one side of the polygon of a second patch antenna pattern 112*a*, 112*b*, 112*c*, 112*d*, or 112*e* and an opposing side of the polygon of the adjacent first patch antenna pattern 112*a*, 112*b*, 112*c*, 112*d*, or 112*e* may not be parallel to each other.

As a result, one side of a polygon of each of the second patch antenna patterns 112*a*, 112*b*, 112*c*, 112*d*, and 112*e* may not face a second patch antenna pattern adjacent thereto, and thus, a phenomenon in which electric fields and magnetic fields of the second patch antenna patterns 112*a*, 112*b*, 112*c*, 112*d*, and 112*e* cause electromagnetic interference with the adjacent second patch antenna pattern may be reduced. Further, a gain and/or directivity of the second patch antenna patterns 112*a*, 112*b*, 112*c*, 112*d*, and 112*e* may be improved.

The second patch antenna patterns 112*a*, 112*b*, 112*c*, 112*d*, and 112*e* may be directly fed with power through feed vias 120*e*.

For example, the feed vias 120*e* feed power indirectly to the first patch antenna patterns 111*a*, 111*b*, 111*c*, 111*d*, and 111*e*, and feed power directly to the second patch antenna patterns 112*a*, 112*b*, 112*c*, 112*d*, and 112*e*, to serve as electrical paths for both the first and second RF signals of different frequencies.

For example, the feed vias 120*e* include second feed patterns 118*e*, thereby reducing electromagnetic interference between radiation patterns of the first patch antenna patterns 111*a*, 111*b*, 111*c*, 111*d*, and 111*e* and radiation patterns of the second patch antenna patterns 112*a*, 112*b*, 112*c*, 112*d*, and 112*e*.

The second patch antenna patterns 112*a*, 112*b*, 112*c*, 112*d*, and 112*e* may each have second slits S2*a*, S2*b*, S2*c*, and S2*d*.

A second length L2 of each of the second slits S2*a*, S2*b*, S2*c*, and S2*d* is greater than a first length L1 of each of the first patch antenna patterns 111*a*, 111*b*, 111*c*, 111*d*, and 111*e*.

A second width W2 of each of the second slits S2*a*, S2*b*, S2*c*, and S2*d* may be greater than a first width W1 of each of the first patch antenna patterns 111*a*, 111*b*, 111*c*, 111*d*, and 111*e*.

Accordingly, the second patch antenna patterns 112*a*, 112*b*, 112*c*, 112*d*, and 112*e* may have a structure that is relatively more suitable for direct power feeding, and the first patch antenna patterns 111*a*, 111*b*, 111*c*, 111*d*, and 111*e* may have a structure that is relatively more suitable for indirect power feeding. Thus, the antenna apparatus 1-1 may improve an overall gain for the first and second RF signals of different frequencies.

Since the second patch antenna patterns 112*a*, 112*b*, 112*c*, 112*d*, and 112*e* may be smaller in size than the first patch antenna patterns 111*a*, 111*b*, 111*c*, 111*d*, and 111*e*, electromagnetic interference between the first patch antenna patterns 111*a*, 111*b*, 111*c*, 111*d*, and 111*e* and the second patch antenna patterns 112*a*, 112*b*, 112*c*, 112*d*, and 112*e* may be further reduced.

Figure 1C:
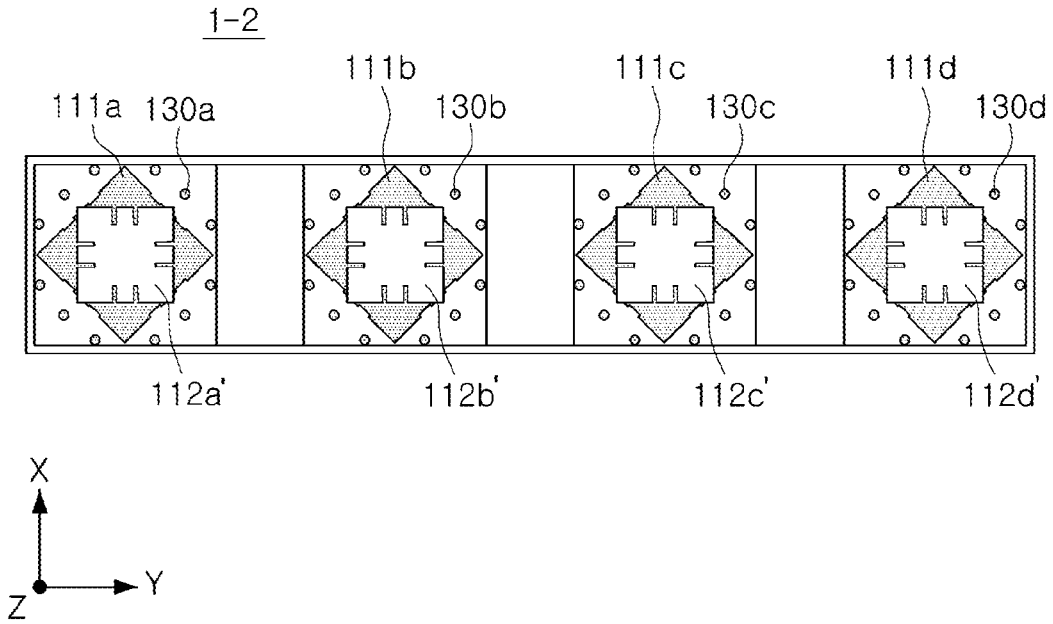
FIG. 1C is a plan view illustrating an arrangement relationship of first and second patch antenna patterns of an antenna apparatus, according to an example.

FIG. 1C is a plan view illustrating an arrangement relationship of first and second patch antenna patterns 112*a*', 112*b*', 112*c*' and 112*d*' of an antenna apparatus 1-2, according to an example.

Referring to FIG. 1C, the second patch antenna patterns 112*a*', 112*b*', 112*c*', and 112*d*' may be disposed to have a form rotated by 45 degrees relative to the first patch antenna patterns 111*a*, 111*b*, 111*c*, and 111*d*.

For example, some sides of polygons of the second patch antenna patterns 112*a*', 112*b*', 112*c*' and 112*d*' may be disposed in parallel with respect to an array direction, for example, the Y direction.

Figure 1D:
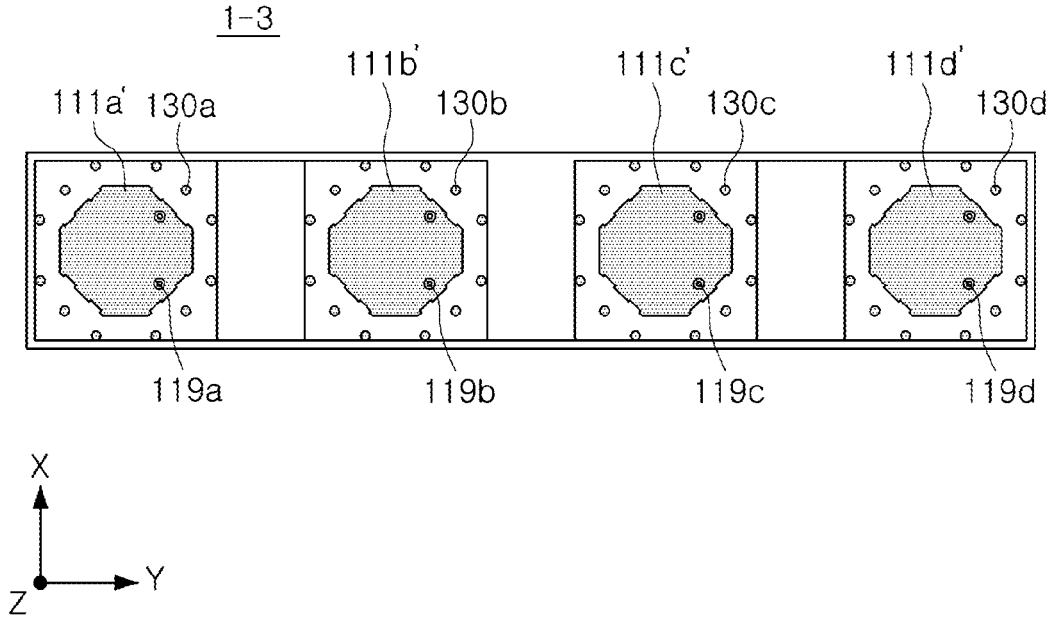
FIG. 1D is a plan view illustrating an antenna apparatus including first patch antenna patterns having a modified form, according to the example.

FIG. 1D is a plan view illustrating an antenna apparatus 1-3 including first patch antenna patterns 111*a*'. 111*b*', 111*c*', and 111*d*' having a modified form, according to an example.

Referring to FIG. 1D, portions of some sides of the first patch antenna patterns 111*a*', 111*b*', 111*c*', and 111*d*' may be disposed in parallel with respect to the array direction of the plurality of first patch antenna patterns 111*a*', 111*b*', 111*c*', and 111*d*', for example, the Y direction.

For example, all the sides of the first patch antenna patterns 111*a*', 111*b*', 111*c*' and 111*d*', may not be oblique with respect to the array direction, for example, the Y direction. That is only some of the sides of the first patch antenna patterns 111*a*', 111*b*', 111*c*' and 111*d*', may be oblique with respect to the array direction.

Referring to FIGS. 2A and 2B, an antenna apparatus 1-4, according to an example, may further include coupling patch patterns 115*e* arrayed above the first and second patch antenna patterns 111*e* and 112*e* to be spaced apart from each other.

The coupling patch patterns 115*e* may be electromagnetically coupled to the second patch antenna pattern 112*e* to provide additional impedance to the second patch antenna pattern 112*e*, such that a bandwidth of the second patch antenna pattern 112*e* may be widened.

A bandwidth of the first patch antenna pattern 111*e* may be widened by coupling of guide vias 130*e*.

Figure 3A:
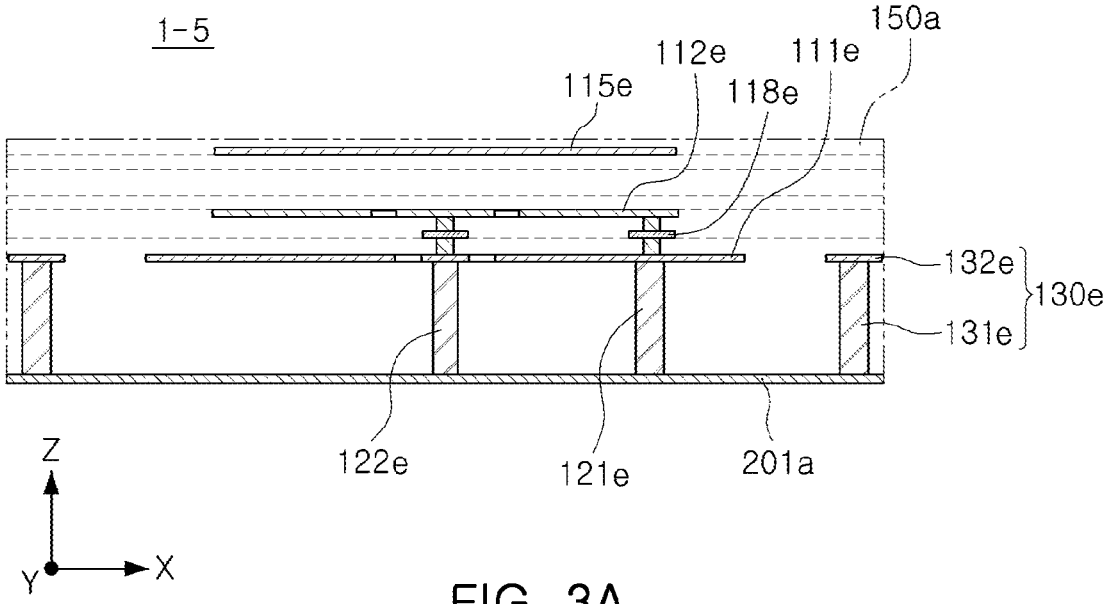
FIG. 3A is a side view of an antenna apparatus, according to an example.

FIG. 3A is a side view of an antenna apparatus 1-5, according to an example.

Referring to FIGS. 2B and 3A, the plurality of guide vias 130*e* may each include guide via cores 131*e* and guide patterns 132*e*.

The guide via cores 131*e* may be connected to the ground plane 201*a*.

The guide patterns 132*e* have a width greater than that of the guide via cores 131*e*, and may be located at substantially the same height as the first patch antenna patterns 111*a* (FIG. 1B) and 111*e*. As a result, the guide vias 130*e* may guide surface currents of the first patch antenna patterns 111*a* and 111*e* to flow more intensively to oblique sides of the first patch antenna patterns 111*a* and 111*e*.

In addition, the antenna apparatus according to an example may further include second feed vias 122*e* disposed in parallel to the feed vias 121*e*.

For example, the feed vias 121*e* are electrically connected to the first and second patch antenna patterns 111*a* (FIG. 1B), 111*e*, 112*a* (FIG. 1B), and 112*e*, and may be located to be biased in a first direction from a center of the first and second patch antenna patterns 111*a*, 111*e*, 112*a* and 112*e*, and the second feed vias 122*e* may be electrically connected to the first and second patch antenna patterns 111*a*, 111*e*, 112*a*, and 112*e* and may be located to be biased in a second direction from a center of the first and second patch antenna patterns 111*a*, 111*e*, 112*a*, and 112*e*.

Accordingly, a first surface current corresponding to an RF signal of an Horizontal polarization (H-pol.), transmitted through the feed vias 121*e*, and a second surface current corresponding to an RF signal of a (Vertical polarization) V-pol., transmitted through the second feed vias 122*e*, may be orthogonal to the first and second patch antenna patterns 111*a*, 111*e*, 112*a*, and 112*e*.

Therefore, an electric field corresponding to the RF signal of the H-pol. may be orthogonal to an electric field corresponding to the RF signal of the V-pol., and a magnetic field corresponding to the RF signal of the H-pol. may be orthogonal to a magnetic field corresponding to the RF signal of the V-pol., and the RF signal of the H-pol. and the RF signal of the V-pol. may form polarized waves.

The antenna apparatus 1-5 may be configured in such a manner that a direction of the first surface current, corresponding to the RF signal of the H-pol., and a direction of the second surface current, corresponding to the RF signal of the V-pol., are both oblique with respect to the array direction of the first and second patch antenna patterns 111*a*, 111*e*, 112*a*, and 112*e*.

Accordingly, a phenomenon in which the electric field and the magnetic field of the first and second patch antenna patterns 111*a*, 111*e*, 112*a*, and 112*e* cause electromagnetic interference with the adjacent first and second patch antenna patterns may be reduced, the gain and/or the directivity of the plurality of first and second patch antenna patterns 111*a*, 111*e*, 112*a*, and 112*e* may be improved.

Figure 3B:
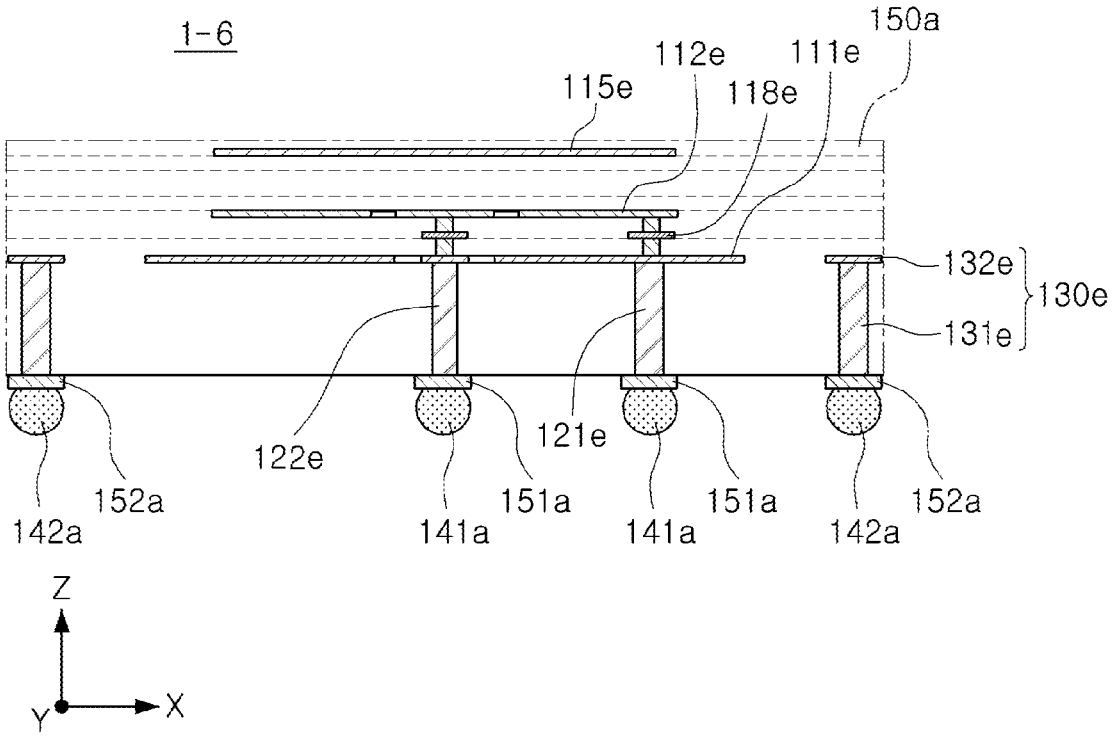
FIG. 3B is a side view illustrating an independent component structure of an antenna apparatus, according to an example.

FIG. 3B is a side view illustrating an independent component structure of an antenna apparatus 1-6, according to an example.

Referring to FIG. 3B, the antenna apparatus 1-5 may be similar to the antenna apparatus 1-4 of FIG. 3A, except that the antenna apparatus 1-5 may further include first electrical connection structures 141*a* and second electrical connection structures 142*a*.

The first electrical connection structures 141*a* may be respectively electrically connected to the feed vias 121*e* and the second feed vias 122*e* and may have a melting point lower than that of the feed vias 121*e* and the second feed vias 122*e* corresponding thereto.

The second electrical connection structures 142*a* may be respectively electrically connected to the guide vias 130*e* and may have a melting point lower than that of the guide vias 130*e* corresponding thereto.

For example, the first and second electrical connection structures 141*a* and 142*a* may have a structure such as a solder ball, a pin, a land, or a pad.

The antenna apparatus 1-6 may be designed as an independent component electrically connected to an upper surface of a connection member, for example, a substrate, a printed circuit board (PCB), or the like.

The antenna apparatus 1-6 may further include the dielectric body 150*a*, in which the first patch antenna patterns 111*a*, 111*b*, 111*c*, 111*d*, and 111*e*, the feed vias 121*e*, and the guide vias 130*e* are disposed, and which has the form of a polyhedron comprised of oblique sides with respect to oblique sides of the plurality of first patch antenna patterns 111*a*, 111*b*, 111*c*, 111*d*, and 111*e*.

First and second pads 151*a* and 152*a* may be disposed on a lower surface of the dielectric body 150*a*. The first pads 151*a* may electrically connect the first electrical connection structure 141*a* to the feed vias 121*e* and the second feed vias 122*e*, and the second pads 152*a* may electrically connect the second electrical connection structure 142*a* and guide vias 130*e* to each other.

Figure 4A:
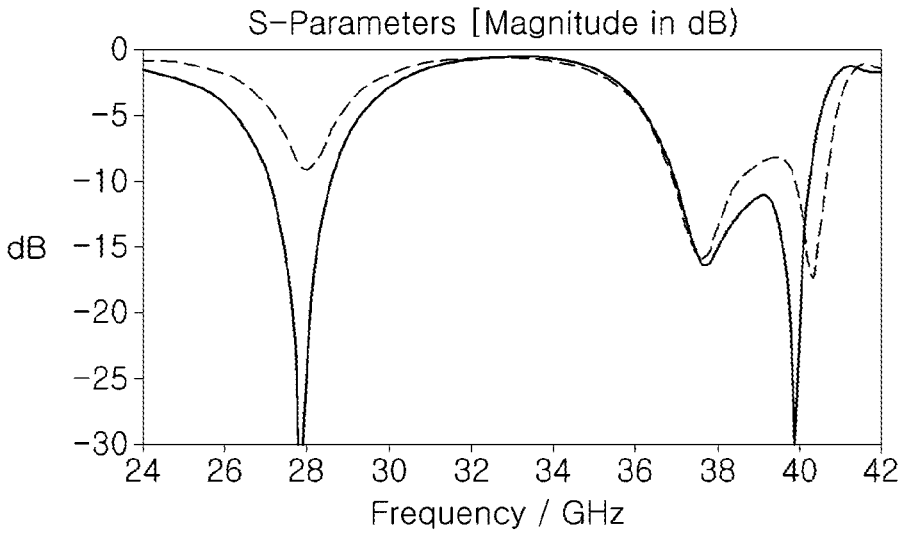
FIG. 4A is an S-parameter graph illustrating return loss according to presence or absence of guide vias of an antenna apparatus, according to an example.
Figure 4B:
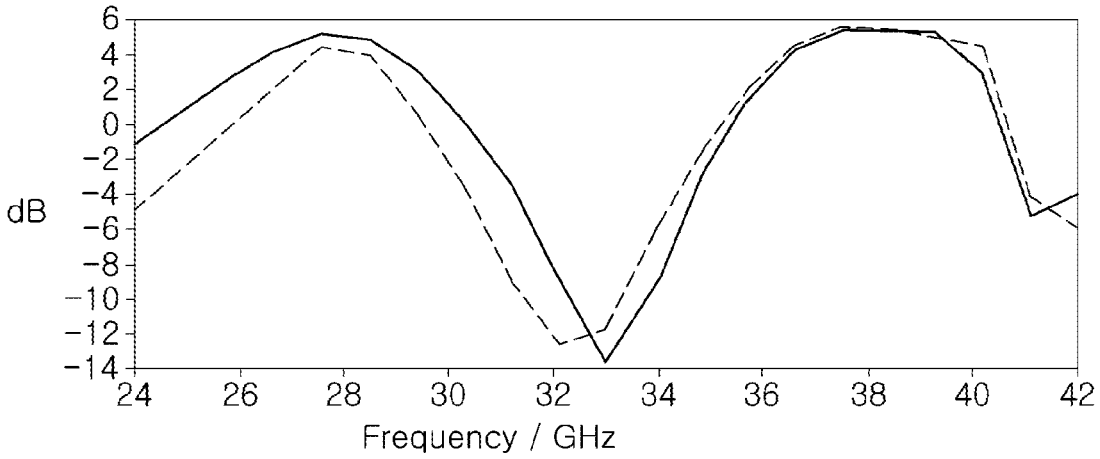
FIG. 4B is a graph illustrating a gain according to presence or absence of guide vias of an antenna apparatus, according to an example.

FIG. 4A is an S-parameter graph illustrating a return loss according to presence or absence of guide vias of an antenna apparatus (e.g., guide vias 130*e*), according to an example. FIG. 4B is a graph illustrating a gain according to presence or absence of guide vias of an antenna apparatus (e.g., guide vias 130*e*), according to an example.

Referring to FIGS. 4A and 4B, the dotted curve illustrates the return loss and gain of the antenna apparatus not including the guide vias, and the solid curve illustrates the return loss and gain of the antenna apparatus including the guide vias.

The bandwidth may be defined as a frequency range between a first point and a second point at which a value of an S-parameter is −10 dB.

As illustrated in FIGS. 4A and 4B, in comparison to an antenna apparatus that does not include guide vias, the antenna apparatus including the guide vias may have a relatively wider bandwidth for both a 28 GHz frequency of a first RF signal and a 39 GHz frequency of a second RF signal, and may further increase the gain corresponding to 28 GHz that is the frequency of the first RF signal.

Figure 5A:
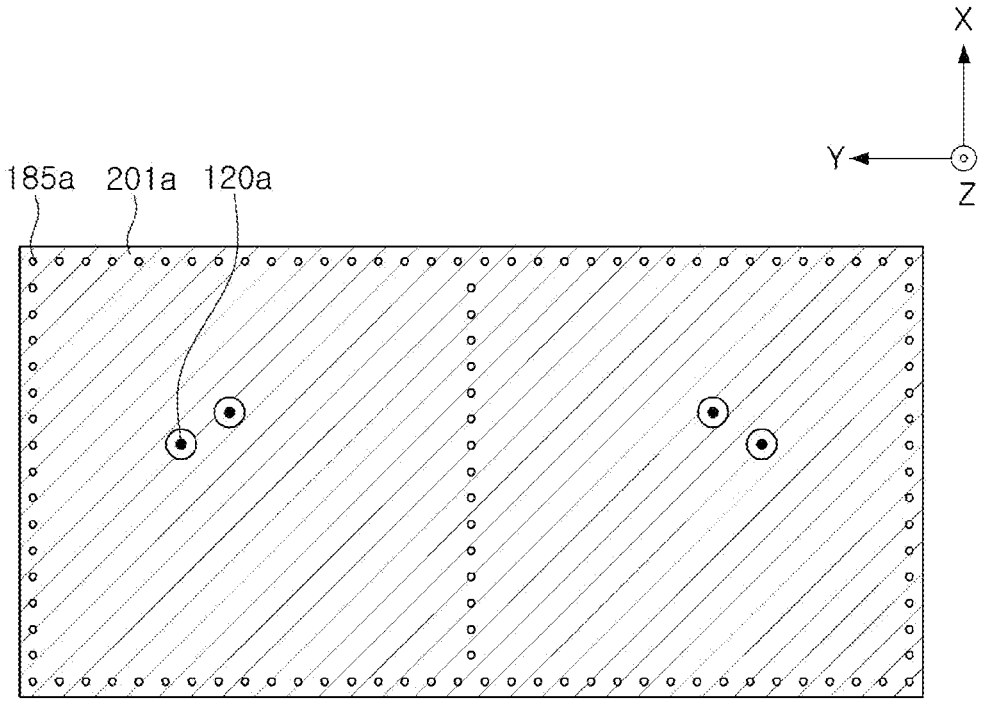
FIG. 5A is a plan view illustrating a ground plane of an antenna apparatus, according to an example.
Figure 5B:
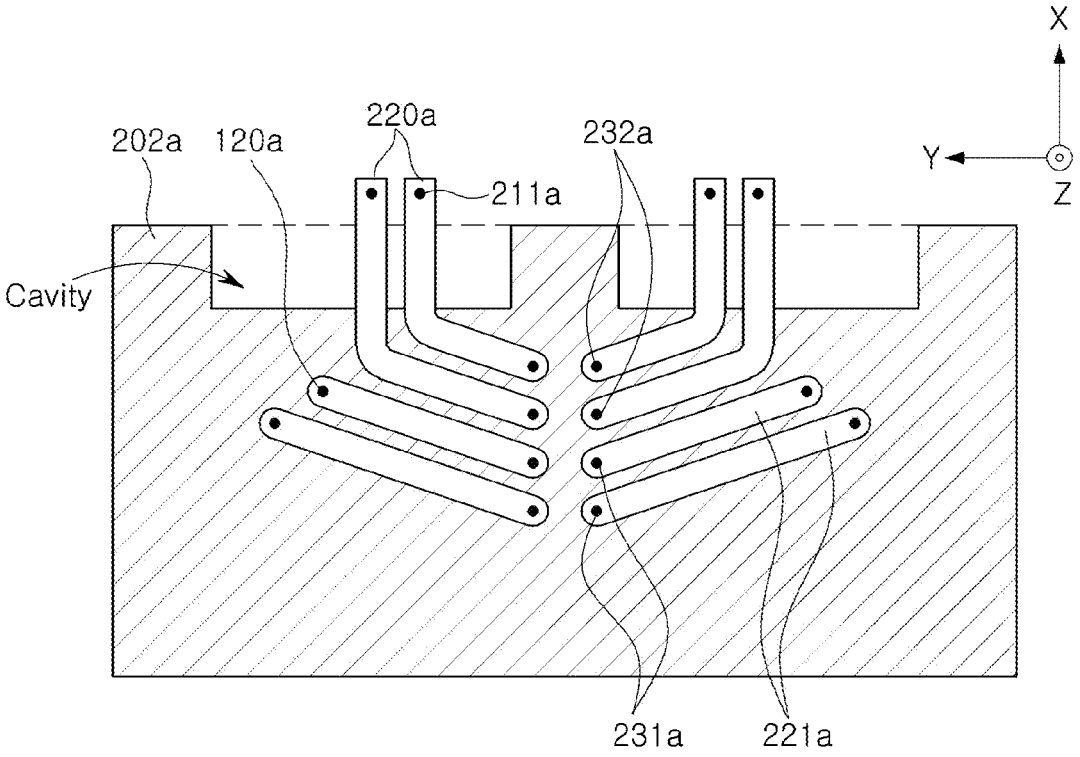
FIG. 5B is a plan view illustrating a feed line on a lower side of the ground plane of FIG. 5A.
Figure 5C:
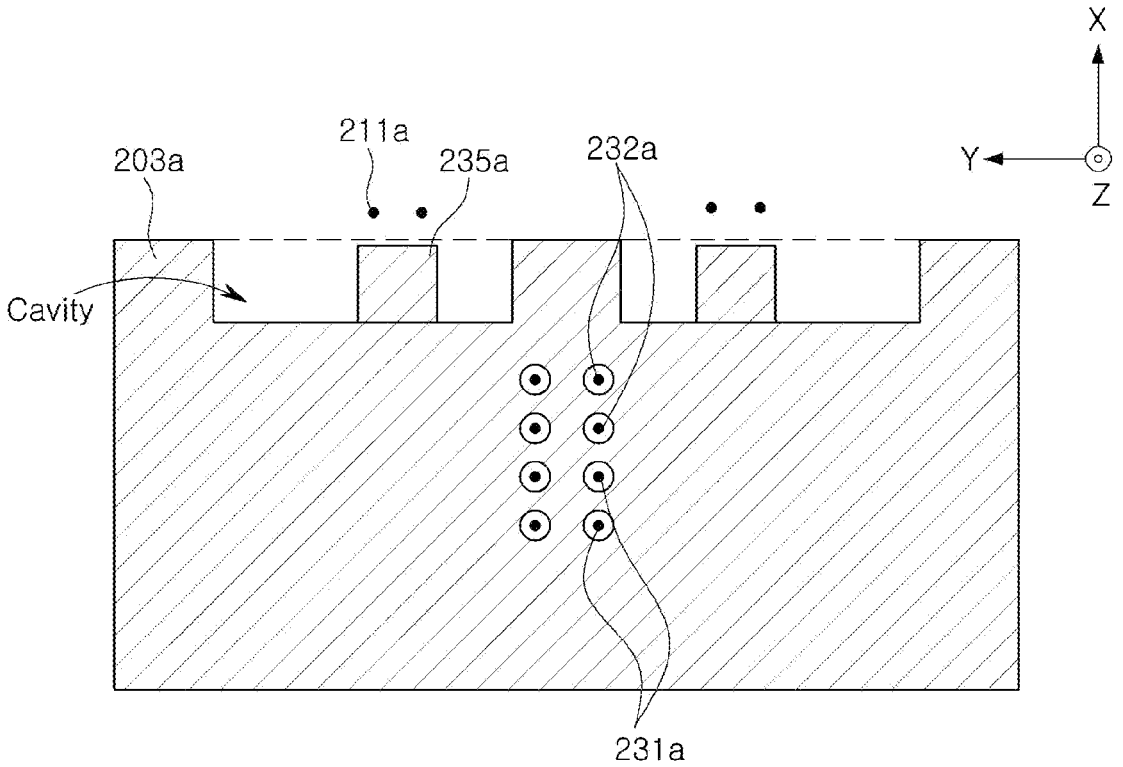
FIG. 5C is a plan view illustrating wiring vias below the feed line of FIG. 5B and a second ground plane.
Figure 5D:
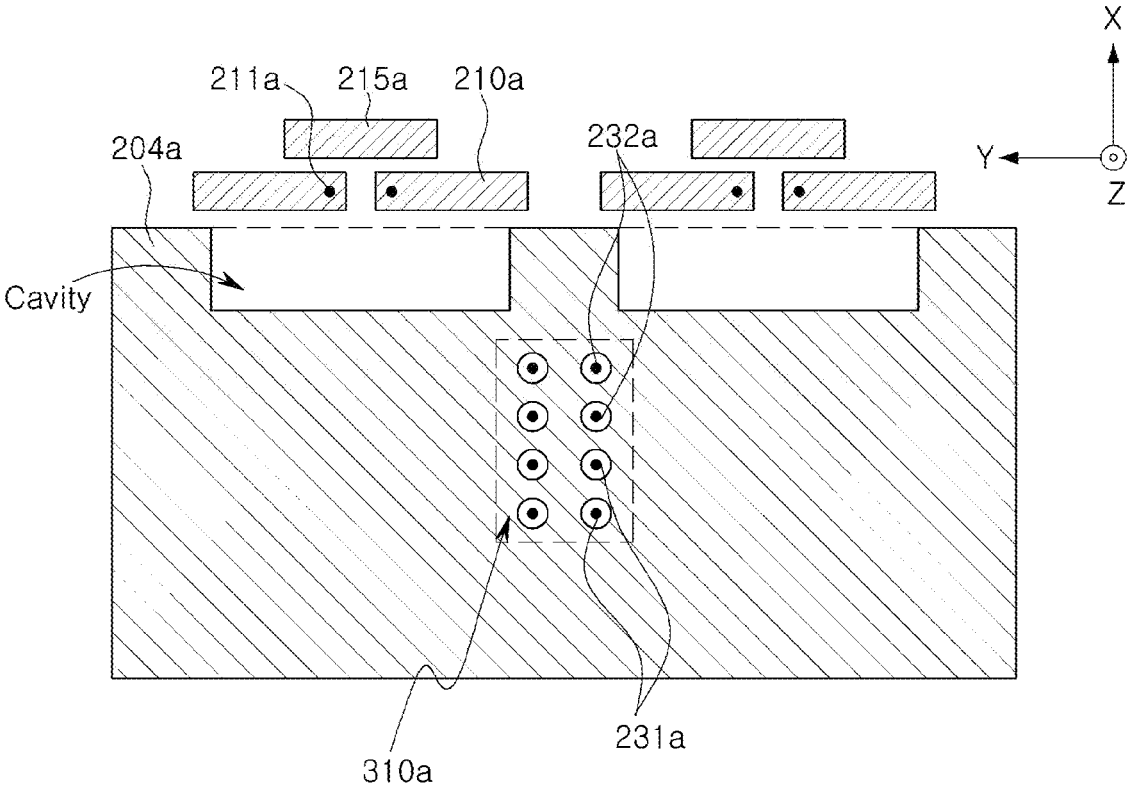
FIG. 5D is a plan view illustrating an IC placement region below the second ground plane of FIG. 5C and an end-fire antenna pattern.

FIG. 5A is a plan view illustrating a ground plane 201*a* of an antenna apparatus, according to an example. FIG. 5B is a plan view illustrating a feed line 221*a* on a lower side of the ground plane 201*a* of FIG. 5A. FIG. 5C is a plan view illustrating wiring vias 231*a* and 232*a* below the feed line 221*a* of FIG. 5B and a second ground plane 203*a*. FIG. 5D is a plan view illustrating an IC placement region below the second ground plane 203*a* of FIG. 5C and an end-fire antenna pattern 210*a*.

Referring to FIG. 5A, the ground plane 201*a* may have a through-hole through which a feed via 120*a* passes, and may electromagnetically shield a patch antenna pattern from a feed line. A shielding via 185*a* may extend toward a lower side, for example, in a Z direction.

Referring to FIG. 5B, a wiring ground plane 202*a* may respectively surround at least a portion of an end-fire antenna feed line 220*a* and a feed line 221*a*. The end-fire antenna feed line 220*a* may be electrically connected to a second wiring via 232*a*, and the feed line 221*a* may be electrically connected to a first wiring via 231*a*. The wiring ground plane 202*a* may electromagnetically shield between the end-fire antenna feed line 220*a* and the feed line 221*a*. One end of the end-fire antenna feed line 220*a* may be connected to a second feed via 211*a*.

Referring to FIG. 5C, the second ground plane 203*a* may have through-holes through which the first wiring vias 231*a* and the second wiring vias 232*a* pass, respectively, and may have a coupling ground pattern 235*a*. The second ground plane 203*a* may electromagnetically shield between the feed line and an IC.

Referring to FIG. 5D, an IC ground plane 204*a* may include through-holes through which the first wiring vias 231*a* and the second wiring vias 232*a* pass. An IC 310*a* may be disposed below the IC ground plane 204*a* and may be electrically connected to the first wiring vias 231*a* and the second wiring vias 232*a*. The end-fire antenna pattern 210*a* and a director pattern 215*a* may be disposed at substantially the same height as the IC ground plane 204*a*.

The IC ground plane 204*a* may provide the IC 310*a* and/or passive components with the ground used in the circuit of the IC 310*a* and/or the passive components. Depending on the design, the IC ground plane 204*a* may provide a power and signal transmission path for the IC 310*a* and/or the passive components. Thus, the IC ground plane 204*a* may be electrically connected to the IC and/or the passive components.

On the other hand, the vertical relationship and the shape of the wiring ground plane 202*a*, the second ground plane 203*a*, and the IC ground plane 204*a* may vary depending on the design.

Figure 6A:
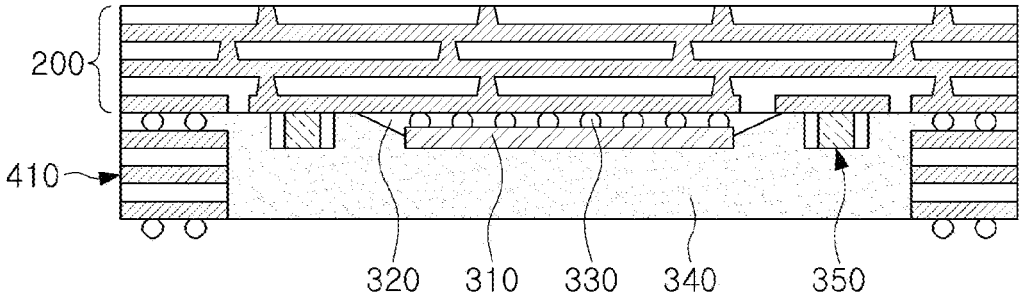
FIGS. 6A and 6B are side views illustrating a bottom structure of an antenna apparatus, according to an example.
Figure 6B:
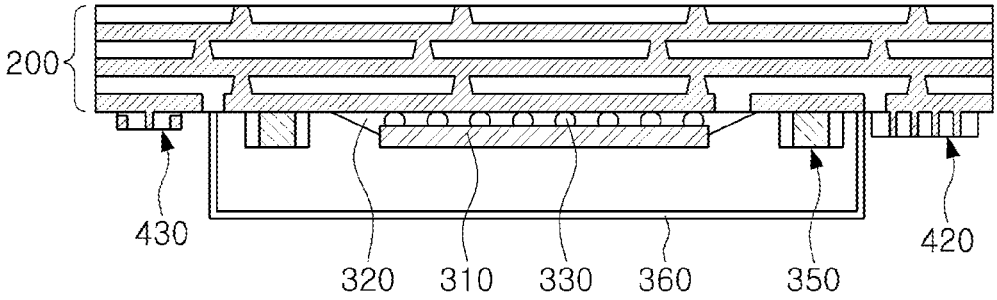

FIGS. 6A and 6B are side views illustrating a lower structure of an antenna apparatus, according to an example.

Referring to FIG. 6A, an antenna apparatus may include at least a portion of a connection member 200, an IC 310, an adhesive member 320, an electrical connection structure 330, an encapsulant 340, a passive component 350, and a core member 410.

The connection member 200 may have a structure in which the ground plane, the wiring ground plane, the second ground plane, the IC ground plane, and an insulating layer described above are laminated.

The IC 310 is the same as the above-described IC, and may be disposed below the connection member 200. The IC 310 may be electrically connected to the wiring of the connection member 200 to transmit or receive RF signals, and may be electrically connected to the ground plane of the connection member 200 to receive the ground. For example, the IC 310 may perform at least a portion of frequency conversion, amplification, filtering, phase control, and power generation to generate a converted signal.

The adhesive member 320 may bond the IC 310 and the connection member 200 to each other.

The electrical connection structure 330 may electrically connect the IC 310 and the connection member 200 to each other, and may have a melting point lower than that of the wiring of the connection member 200 and the ground plane, and thus, may electrically connect the IC 310 and the connection member 200 to each other, using a process using the low melting point.

The encapsulant 340 may seal at least a portion of the IC 310 and may improve heat radiation performance and shock protection performance of the IC 310. For example, the encapsulant 340 may be implemented by a Photo Imageable Encapsulant (PIE), an Ajinomoto Build-up Film (ABF), an epoxy molding compound (EMC), or the like.

The passive component 350 may be disposed on a lower surface of the connection member 200 and may be electrically connected to the wiring and/or the ground plane of the connection member 200 through the electrical connection structure 330. For example, the passive component 350 may include at least a portion of a capacitor such as a Multi Layer Ceramic Capacitor (MLCC), an inductor, or a chip resistor.

The core member 410 may be disposed on a lower side of the connection member 200, and may be electrically connected to the connection member 200 to receive an intermediate frequency (IF) signal or a baseband signal externally and transmit the signal to the IC 310, or to receive the IF signal or the baseband signal from the IC 310 to transmit the signal externally. In this example, the frequency, for example, 24 GHz, 28 GHz, 36 GHz, 39 GHz, or 60 GHz, of the RF signal is greater than the frequency, for example, 2 GHz, 5 GHz, 10 GHz or the like, of the IF signal.

For example, the core member 410 may transmit the IF signal or the baseband signal to the IC 310 or may receive the signal from the IC 310 through a wiring that may be included in the IC ground plane of the connection member 200. Since a first ground plane of the connection member 200 is disposed between the IC ground plane and the wiring, the IF signal or the baseband signal and the RF signal may be electrically isolated in the antenna apparatus.

Referring to FIG. 6B, the antenna apparatus may include at least a portion of a shielding member 360, a connector 420, and an end-fire chip antenna 430.

The shielding member 360 may be disposed below the connection member 200 to confine the IC 310, together with the connection member 200. For example, the shielding member 360 may be disposed to cover together, for example, conformally shield the IC 310 and the passive component 350. Alternatively, the shielding member 360 may be disposed to respectively cover, for example, compartmentally shield the IC 310 and the passive component 350. For example, the shielding member 360 may have the form of a hexahedron of which one surface is open, and may have a receiving space having a hexahedral shape through coupling with the connection member 200. The shielding member 360 may be formed of a material having high conductivity, such as copper, to have a relatively short skin depth, and may be electrically connected to the ground plane of the connection member 200. Accordingly, the shielding member 360 may reduce electromagnetic noise that may affect the IC 310 and the passive component 350.

The connector 420 may have a connection structure of a cable (for example, a coaxial cable, or a flexible PCB), and may be electrically connected to the IC ground plane of the connection member 200. The connector 420 may perform a similar role as the core member 410 described above. For example, the connector 420 may receive an IF signal, a baseband signal, and/or power from a cable, or may provide an IF signal and/or a baseband signal to the cable.

The end-fire chip antenna 430 may transmit or receive an RF signal by assisting the antenna apparatus. For example, the end-fire chip antenna 430 may include a dielectric block having a dielectric constant greater than that of an insulating layer, and electrodes disposed on both surfaces of the dielectric block. One of the electrodes may be electrically connected to the wiring of the connection member 200 and the other of the electrodes may be electrically connected to the ground plane of the connection member 200.

Figure 7:
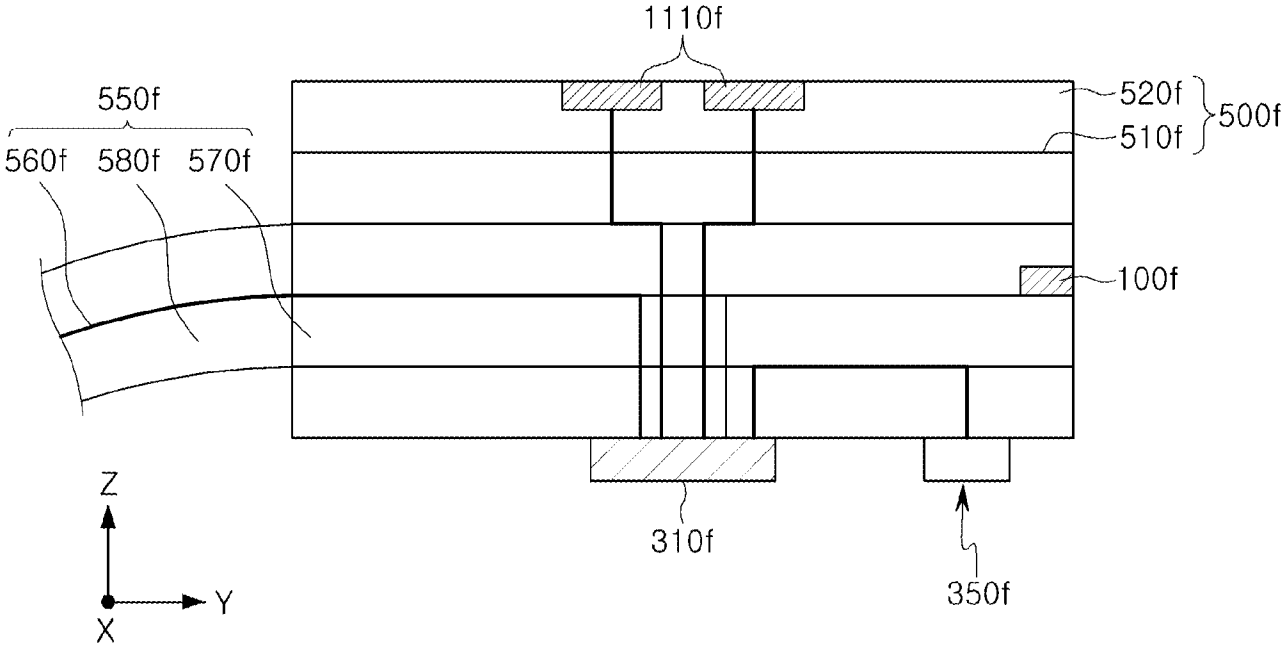
FIG. 7 is a side view illustrating a structure of an antenna apparatus, according to an example.

FIG. 7 is a side view illustrating a structure of an antenna apparatus, according to an example.

Referring to FIG. 7, the antenna apparatus may have a structure in which an end-fire antenna 100*f*, a patch antenna pattern 1110*f*, an IC 310*f*, and a passive component 350*f* are integrated with a connecting member 500*f*.

The end-fire antenna 100*f* and the patch antenna pattern 1110*f* may be designed in the same manner as the above-described antenna apparatuses and the above-described patch antenna patterns. The end-fire antenna 100*f* and the patch antenna pattern 1110*f* may receive RF signals from the IC 310*f* to transmit the signals, or may transmit the received RF signals to the IC 310*f*.

The connection member 500*f* may have a structure in which at least one conductive layer 510*f* and at least one insulating layer 520*f* are laminated (for example, a structure of a printed circuit board). The conductive layer 510*f* may have a ground plane and a feed line as described above.

In addition, the antenna apparatus may further include a flexible connection member 550*f*. The flexible connection member 550*f* may include a first flexible region 570*f* that overlaps the connection member 500*f* in a vertical direction (e.g., the Z direction) and a second flexible region 580*f* that does not overlap the connection member 500*f* in the vertical direction.

The second flexible region 580*f* may be flexibly bent in a vertical direction (e.g., the Z direction). Accordingly, the second flexible region 580*f* may be flexibly connected to a connector of a set substrate and/or an adjacent antenna apparatus.

The flexible connection member 550*f* may include a signal line 560*f*. Intermediate frequency (IF) signals and/or baseband signals may be transmitted to the IC 310*f* or to the connector of the set substrate and/or an adjacent antenna apparatus, via the signal line 560*f*.

Figure 8:
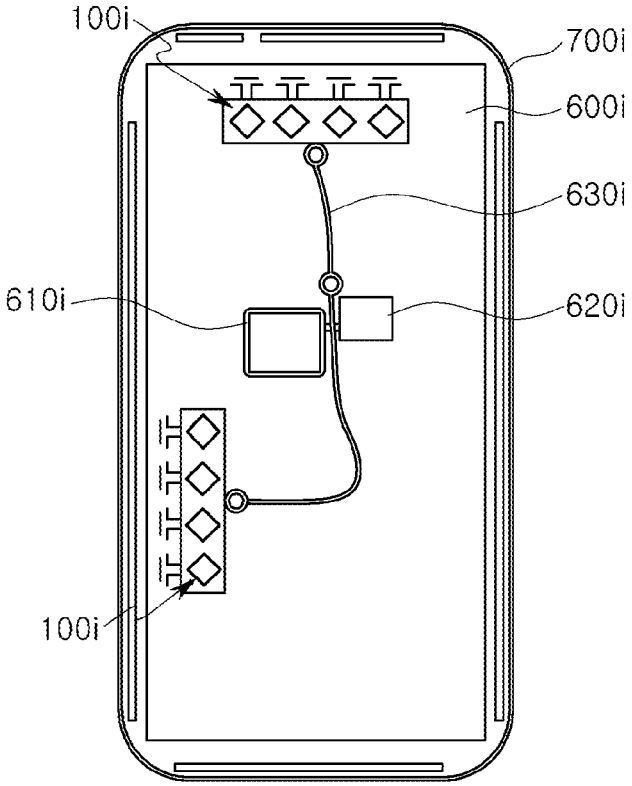
FIG. 8 is a plan view illustrating an arrangement of an antenna apparatus in an electronic device, according to an example.

FIG. 8 is a plan view illustrating an arrangement of an antenna apparatus in an electronic device 700*i*, according to an example.

Referring to FIG. 8, the antenna apparatus including an antenna unit 100*i* may be disposed adjacent to a side edge of the electronic device 700*i* on a set substrate 600*i* of the electronic device 700*i*.

The electronic device 700*i* may be a smartphone, a personal digital assistant, a digital video camera, a digital still camera, a network system, a computer, a monitor, a tablet PC, a laptop computer, a netbook, a television set, a video game, a smartwatch, an automobile, or the like, but is not limited to these examples.

A communication module 610*i* and a baseband circuit 620*i* may be further disposed on the set substrate 600*i*. The antenna apparatus may be electrically connected to the communication module 610*i* and/or the baseband circuit 620*i* via a coaxial cable 630*i*.

The communication module 610*i* may include at least a portion of a memory chip such as a volatile memory (for example, a dynamic random access memory (DRAM)), a nonvolatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like, to perform digital signal processing.

The baseband circuit 620*i* may perform analog-to-digital conversion, amplification for an analog signal, filtering, and frequency conversion to generate a base signal. The base signal input/output from the baseband circuit 620*i* may be transmitted to the antenna apparatus via a cable.

For example, the base signal may be transmitted to the IC through the electrical connection structure, the core via, and the wiring. The IC may convert the base signal into an RF signal in a millimeter wave (mmWave) band.

The patch antenna patterns, the coupling patch patterns, the feed vias, the guide vias, the feed patterns, the guide patterns, the ground planes, and the electrical connection structures disclosed in the examples may include a metal material, for example, a conductive material, such as copper (Cu), aluminum (Al), silver (Ag), tin (Sn), gold (Au), nickel (Ni), lead (Pb), titanium (Ti), or alloys thereof, and may be formed depending on a plating method, such as chemical vapor deposition (CVD), physical vapor deposition (PVD), sputtering, subtractive, additive, a semi-additive process (SAP), a modified semi-additive process (MSAP), or the like. However the patch antenna patterns, the coupling patch patterns, the feed vias, the guide vias, the feed patterns, the guide patterns, the ground planes, and the electrical connection structures are not limited to the foregoing materials and manufacturing methods.

An insulating layer and a dielectric layer, according to examples, may also be implemented by FR4, Liquid Crystal Polymer (LCP), Low Temperature Co-fired Ceramic (LTCC), a thermosetting resin such as epoxy resin, a thermoplastic resin such as polyimide, or a resin formed by impregnating these resins in a core material such as a glass fiber, a glass cloth, a glass fabric, or the like, together with an inorganic filler, a prepreg material, Ajinomoto Build-up Film (ABF), Bismaleimide Triazine (BT) resin, a photoimageable dielectric (PID) resin, a copper clad laminate (CCL), an insulating material of glass or ceramic series, or the like. The insulating layer and the dielectric layer may fill at least a portion of the antenna apparatus, in which the patch antenna pattern, the coupling patch pattern, the feed via, the guide via, the feed pattern, the guide pattern, the ground plane and the electrical connection structure are not disposed.

The RF signals according to the examples may be used in various communications protocols such as Wi-Fi (IEEE 802.11 family or the like), WiMAX (IEEE 802.16 family or the like), IEEE 802.20, Long Term Evolution (LTE), Ev-DO, HSPA+, HSDPA+, HSUPA+, EDGE, GSM, GPS, GPRS, CDMA, TDMA, DECT, Bluetooth, 3rd Generation (3G), 4G, 5G and various wireless and wired protocols designated thereafter. However, the RF signals are not limited to being used in the foregoing communications protocols.

As set forth above, an antenna apparatus, according to an example, may improve antenna performance, for example, a gain, a bandwidth, directivity or the like, and/or may have a structure favorable for miniaturization.

The communication module **610*i* in FIG. 8** that performs the operations described in this application is implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

first patch antenna patterns arrayed in an N×1 structure, the first patch antenna patterns each configured to have a first polygonal shape having an oblique side with respect to an array direction of the N×1 structure;

feed vias electrically connected to the first patch antenna patterns;

second patch antenna patterns spaced apart from each other and disposed above the first patch antenna patterns, the second patch antenna patterns each having an area less than an area of a corresponding first patch antenna pattern among the first patch antenna patterns; and guide vias arrayed along the oblique side, wherein N is a natural number greater than or equal to 2, wherein each of the second patch antenna patterns is configured to have a second polygonal shape having at least one side that is oblique to the oblique side of the first patch antenna patterns.

2. The antenna apparatus of claim 1, wherein each of the first patch antenna patterns comprises first slits located in the oblique side of the first patch antenna patterns.

3. The antenna apparatus of claim 2, wherein portions protruding from the first patch antenna patterns by the first slits protrude toward one of the guide vias.

4. The antenna apparatus of claim 2, wherein each of the second patch antenna patterns comprises second slits located in the second oblique side.

5. The antenna apparatus of claim 4, wherein a length of each of the second slits is greater than a length of each of the first slits.

6. The antenna apparatus of claim 4, wherein a width of each of the second slits is less than a width of each of the first slits.

7. The antenna apparatus of claim 1, further comprising guide patterns each electrically connected to a corresponding guide via among the guide vias, and each having a width greater than a width of the corresponding guide via.

8. The antenna apparatus of claim 7, wherein the guide patterns are disposed at a same height as a height of the first patch antenna patterns.

9. The antenna apparatus of claim 1, wherein the feed vias are configured to feed power directly to the second patch antenna patterns, and to feed power indirectly to the first patch antenna patterns.

10. The antenna apparatus of claim 9, further comprising feed patterns each electrically connected to a corresponding feed via among the feed vias, and each having a width greater than a width of the corresponding feed via, wherein the first patch antenna patterns each have a through-hole in which a corresponding feed pattern among the feed patterns is disposed.

11. The antenna apparatus of claim 9, further comprising coupling patch patterns spaced apart from each other above the second patch antenna patterns.

12. The antenna apparatus of claim 1, wherein each of the feed vias is electrically connected to a corresponding first patch antenna pattern among the first patch antenna patterns, and the feed vias are disposed to be biased toward the oblique side from a center of the corresponding first patch antenna pattern.

13. The antenna apparatus of claim 12, further comprising second feed vias respectively electrically connected to the corresponding first patch antenna pattern among the first patch antenna patterns, wherein the second feed vias are disposed to be biased from the center of the corresponding first patch antenna pattern in a direction different from the direction in which the feed vias are biased from the center of the corresponding first patch antenna pattern.

14. The antenna apparatus of claim 1, further comprising a ground plane having through-holes through which the feed vias penetrate, wherein the guide vias are electrically connected to the ground plane.

15. The antenna apparatus of claim 1, further comprising a dielectric body in which the first patch antenna patterns, the feed vias and the guide vias are disposed, the dielectric body having a polyhedral shape and comprising sides oblique with respect to the oblique side.

16. The antenna apparatus of claim 15, further comprising:

first electrical connection structures each electrically connected to a corresponding feed via among the feed vias, and each having a melting point lower than a melting point of the corresponding feed via; and second electrical connection structures each electrically connected to a corresponding guide via among the guide vias, and each having a melting point lower than a melting point of the corresponding guide via.

* * * * *